US011512481B1

(12) United States Patent
Schlisner

(10) Patent No.: US 11,512,481 B1
(45) Date of Patent: Nov. 29, 2022

(54) PORTABLE APPARATUS FOR APPLICATION OF SHEET ADHESIVE TO FLOORING

(71) Applicant: Base King, LLC, Dalton, GA (US)

(72) Inventor: Devin D. Schlisner, Dalton, GA (US)

(73) Assignee: Base King, LLC, Dalton, GA (US)

( * ) Notice: Subject to any disclaimer, the term of this patent is extended or adjusted under 35 U.S.C. 154(b) by 388 days.

(21) Appl. No.: 16/794,489

(22) Filed: Feb. 19, 2020

Related U.S. Application Data

(60) Provisional application No. 62/808,956, filed on Feb. 22, 2019.

(51) Int. Cl.
*E04G 21/16* (2006.01)
*E04G 21/18* (2006.01)
*E04F 15/02* (2006.01)

(52) U.S. Cl.
CPC ..... *E04G 21/167* (2013.01); *E04F 15/02155* (2013.01); *E04G 21/1841* (2013.01)

(58) Field of Classification Search
CPC ..... E04G 21/167; E04F 15/0215; E04F 15/02155; E04F 13/0887; E04F 21/10; E04F 21/22; B29C 63/02; B32B 7/12; B32B 37/12; B32B 2255/10; B32B 2471/00; Y10T 156/10
See application file for complete search history.

(56) References Cited

U.S. PATENT DOCUMENTS 3,847,647 A * 11/1974 Bahlo ..... E04F 21/023 427/256
5,868,891 A * 2/1999 Weir ..... E04B 1/78 156/184
7,096,642 B2 * 8/2006 Higgins ..... D06N 7/0086 52/741.1
7,763,136 B2 * 7/2010 Richards ..... B65H 35/0033 156/577
7,918,960 B1 * 4/2011 Robell ..... E04C 3/14 156/252
7,993,717 B2 * 8/2011 O'Connor ..... B26F 3/16 428/40.1
8,347,506 B2 * 1/2013 Fuller ..... B27D 1/04 29/430
8,915,280 B1 * 12/2014 Robell ..... B27M 3/0026 156/523
9,409,344 B2 * 8/2016 Schlisner ..... B32B 27/30
9,517,587 B2 12/2016 Schlisner
10,081,742 B1 9/2018 Schlisner
(Continued)

FOREIGN PATENT DOCUMENTS

CN 108438363 A * 8/2018
DE 102018118869 A1 * 2/2019 ..... B29C 63/02
EP 1561568 A1 * 8/2005 ..... B29C 63/02

*Primary Examiner* — Ryan D Kwiecinski

(74) *Attorney, Agent, or Firm* — Luedeka Neely Group, PC

(57) ABSTRACT

Portable apparatus for application of double-sided sheet adhesive to modular flooring products, includes a planar platform; a flooring guide; a roll of double-sided sheet adhesive unrolled onto the platform for marrying with the modular flooring product; a sheet adhesive guide to maintain the sheet adhesive in alignment with the flooring guide and the modular flooring product, and to tension the sheet adhesive as it is applied to the flooring product; and a press roll to apply pressure to mate the sheet adhesive to the flooring product.

6 Claims, 4 Drawing Sheets

(56) References Cited

U.S. PATENT DOCUMENTS

| | | | | |
|---|---|---|---|---|
| 10,183,473 | B2 * | 1/2019 | Bar | B32B 3/16 |
| 10,704,268 | B2 * | 7/2020 | Bradway | C08L 101/00 |
| 10,940,608 | B2 * | 3/2021 | Martin | B05C 5/0204 |
| 11,027,530 | B2 * | 6/2021 | Lozier | B32B 27/12 |
| 2006/0062955 | A1 * | 3/2006 | Liu | B32B 21/04 156/247 |
| 2010/0223872 | A1 * | 9/2010 | Taylor | E04F 15/02188 52/309.3 |
| 2019/0048593 | A1 * | 2/2019 | Kim | B32B 5/02 |
| 2021/0396010 | A1 * | 12/2021 | Rudisill | E04D 3/355 |

* cited by examiner

PORTABLE APPARATUS FOR APPLICATION OF SHEET ADHESIVE TO FLOORING

FIELD

This disclosure relates to the field of modular flooring. More particularly, this disclosure relates to portable apparatus for on-site application of a double-sided sheet adhesive to modular flooring products.

BACKGROUND

Improvement is desired in the application of adhesive to modular flooring products and building materials. What is desired is a portable device that can be transported to a floor installation site to combine dry double-sided sheet adhesive with modular flooring products to facilitate installation of the flooring products.

SUMMARY

The above and other needs are met by a portable apparatus for on-site application of a double-sided sheet adhesive to modular flooring products.

In one aspect, apparatus according to the disclosure includes a planar platform having a first end and an opposite second end; a modular flooring product having an underside slidably disposed along the platform for travel along the platform between the first end and the second end of the platform; a flooring guide adjustably disposed on the platform for contacting and guiding the modular flooring product along the platform. The double-sided sheet adhesive is unrolled onto the platform for location beneath the modular flooring product so that an adhesive surface of the sheet adhesive is placed in contact with the underside of the modular flooring product.

The apparatus also includes a sheet adhesive guide adjustably connected to the flooring guide for contacting the roll to maintain the sheet adhesive in alignment with the flooring guide and the modular flooring product, and to bear against the roll to tension the sheet adhesive as it is applied to the flooring product; and a press roll rotatably mounted adjacent the platform to receive the flooring product having the sheet adhesive applied thereto and operative to apply pressure in a direction toward the platform to securably mate the sheet adhesive to the flooring product.

In another aspect, portable apparatus for application of double-sided sheet adhesive to modular flooring products includes a planar platform; a flooring guide; a roll of double-sided sheet adhesive unrolled onto the platform for marrying with the modular flooring product; a sheet adhesive guide to maintain the sheet adhesive in alignment with the flooring guide and the modular flooring product, and to tension the sheet adhesive as it is applied to the flooring product; and a press roll to apply pressure to mate the sheet adhesive to the flooring product.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
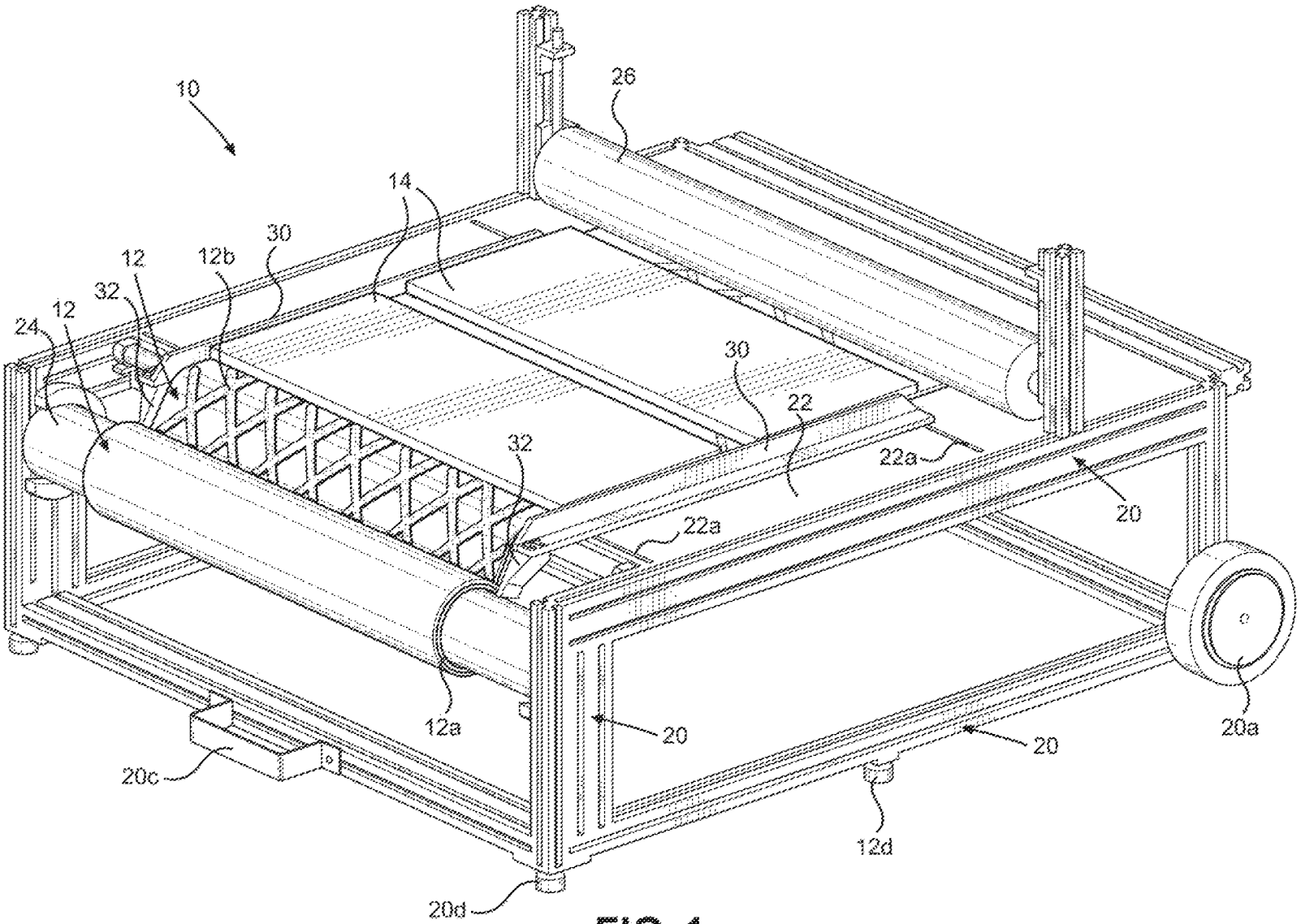
FIG. 1 is a perspective view of portable apparatus according to the disclosure for application of double-sided sheet adhesive to modular flooring products.
Figure 2:
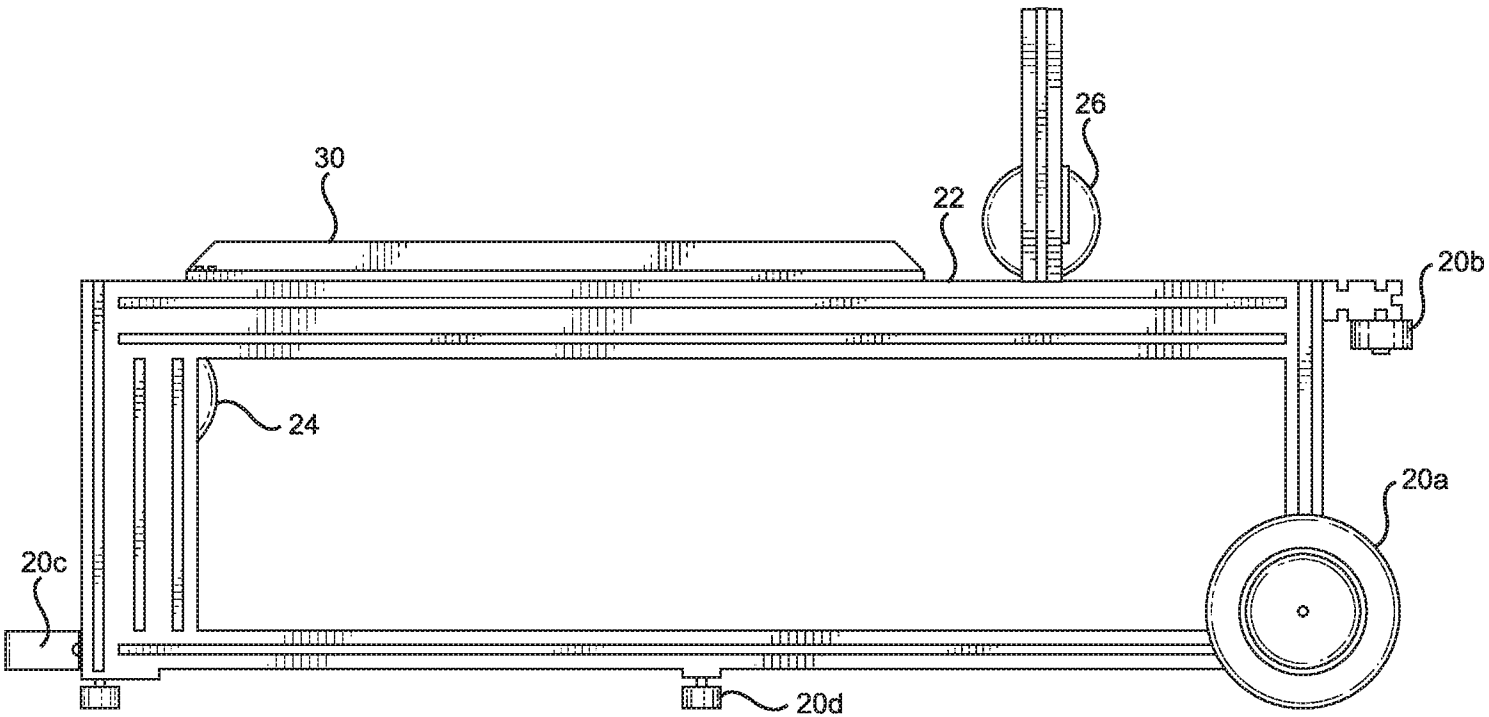
FIG. 2 is a right-side view of the apparatus of FIG. 1 without the double-sided sheet adhesive or the modular flooring products.
Figure 3:
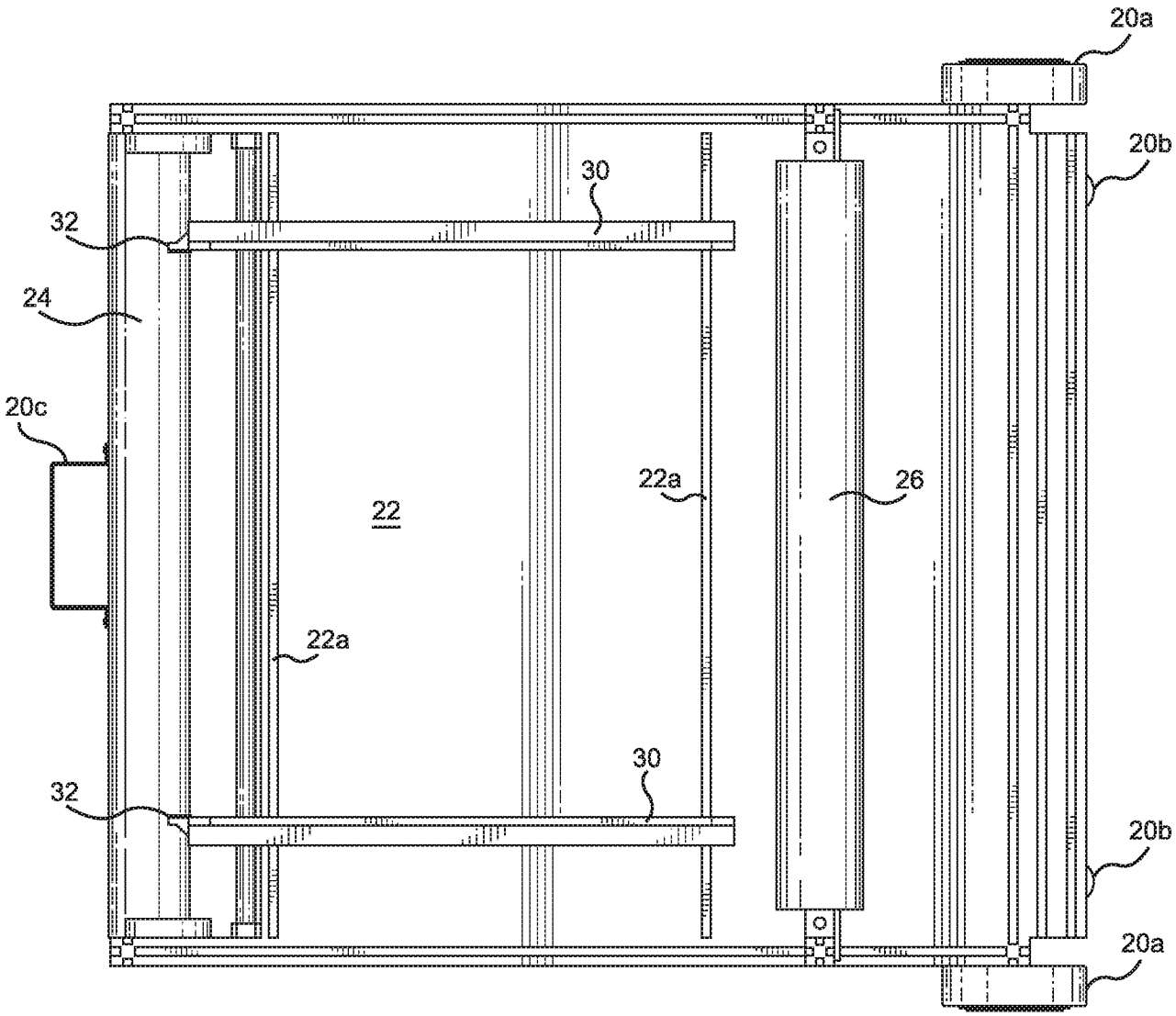
FIG. 3 is a top view of the apparatus of FIG. 2.
Figure 4:
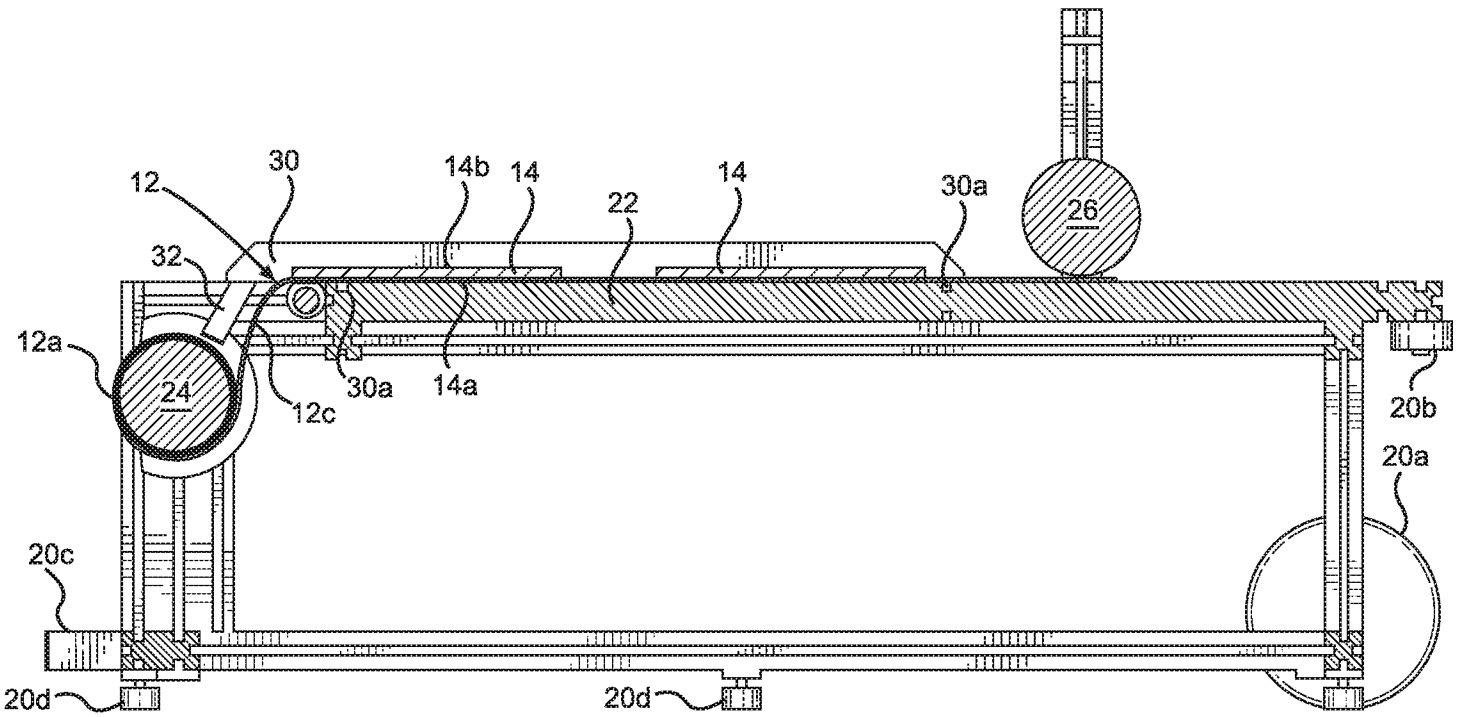
FIG. 4 is a right-side cross-sectional view of the apparatus of FIG. 1 with the double-sided sheet adhesive and the modular flooring products.

With reference to the drawings, the disclosure relates to a portable apparatus 10 for on-site application of a double-sided sheet adhesive 12 to modular flooring. As used herein, modular flooring relates to flooring and materials in discrete sizes, as opposed to large rolls, such as carpet tile, vinyl tile, cove base edgings, plank flooring and other trims and designed building materials with a width of 1 inch and up to 48 inches, and collectively depicted in the drawings as modular flooring products 14. The modular flooring products 14 may be substantially rigid, as in the case of tiles and planks, or flexible, as in the case of carpet tiles. The sheet adhesive 12 is provided on a roll 12*a*.

The apparatus 10 is hand powered by movement of the flooring products 14 and is adjustable to enable application of the sheet adhesive 12 to conform to the flooring products 14, and to enable use of a single width roll of a dry double-sided sheet adhesive and enabling trimming of excess sheet adhesive.

The apparatus 10 includes a portable and generally rectangular frame 20 supporting a planar platform 22 at a central elevated position relative to the frame 20, a roller 24 for receiving the roll 12*a* of the sheet adhesive 12, and a press roll 26 for applying pressure to press the flooring product 14 against the sheet adhesive 12.

To enhance portability of the apparatus 10, the frame 20 includes two sets of wheels each set facing different directions. A lower end wheel set 20*a* is located at a lower end of the frame 20 to locate a wheel on opposite lower sides of the frame 20. The lower end wheel set 20*a* is configured to facilitate a user in pulling the apparatus 10, and for going up or down ramps, stairways and the like. An upper edge wheel set 20*b* is located at an upper edge of the frame 20, preferably above the lower end wheel set 20*a*, so that the wheels of each of the sets 20*a* and 20*b* are oriented perpendicular to one another. The upper edge wheel set 20*b* is used, for example, when the apparatus 10 is oriented vertically or on its end to enable the apparatus 10 to be moved through doorways or narrow hallways or the like. A handle 20*c* is located at a lower end of the frame 20 opposite the wheel sets 20*a* and 20*b* to facilitate manipulation of the frame 20 to utilize the wheel sets 20*a* and 20*b*.

Levelers 20*d* may be provided for leveling the frame 20 when on uneven floors or work surfaces.

The platform 22 provides a table or support surface upon which the sheet adhesive 12 may be unrolled and the flooring products 14 laid on top of the unrolled sheet adhesive 12 to adhere an adhesive surface of the sheet adhesive 12 to a lower surface of the flooring products 14, as explained more fully below. The platform 22, or at least an upper surface thereof, is desirably made of a material having low coefficients of static and dynamic friction, preferably 0.1 or less, such as a sheet of ultra-high-molecular-weight polyethylene (UHMW).

One or more adjustable flooring guides 30 are adjustably positioned on the platform 22 to contact the edges of the flooring product 14 to guide it along the platform 22. The guides 30 are also desirably of low coefficients of friction, and may be provided as by planar, smooth-edged aluminum members having a low friction coating such as silicon-based paint.

As shown, the platform 22 includes a pair of the flooring guides 30 oppositely disposed on the platform 22 so that one of the guides 30 is on either side of the flooring product 14. The guides 30 are elongate planar members having straight edges for contacting the side edges of the flooring product 14. The guides 30 include pegs 30*a* that extend downwardly into elongate slots 22*a* that extend across the platform 22. The guides 30 may be horizontally adjusted relative to the platform 22 by sliding the pegs 30*a* in the slots 22*a*. The pegs 30*a* may include a locking member such as a threaded fastener or the like to lock the legs 30 in position relative to the slots 22*a*.

The guides 30 hold the flooring product 14 in place in order to direct it over the sheet adhesive 12, which is guided into alignment with the flooring product 14 and maintained at a desired tension by adjustable sheet adhesive guides 32.

The sheet adhesive guides 32 are adjustably connected to the proximal ends of the guides 30 and positionable to contact the edges of the roll 12*a* and maintain the sheet adhesive 12 in alignment with the guides 30, and hence the flooring product 14, and to bear against the edges of the roll 12*a* so that a desired tension may be applied to the sheet adhesive 12 for application to the flooring product 14. The desired tension is selected so that the sheet adhesive 12 unwinds straight from the roll 12*a* and remains wrinkle-free as it is applied to the flooring product 14.

The proximal end of the guide 30 may have a slot through which a threaded fastener connectable to the adhesive guide 32 connects, with the slot enabling adjustment of the position of the guide 32 relative to the guide 30. The guides 30 and 32 are desirably adjusted so that the roll 12*a* of the sheet adhesive 12 is fed so that the edges of the sheet adhesive 12 align with the edges of the flooring product 14 and the sheet material 12 feeds straight and at a tension so as to be substantially wrinkle-free.

The roller 24 is rotatably mounted to the frame 20 and may be configured as an aluminum cylindrical shaft sized to an interior diameter of a core of the roll 12*a*. The roller 24 may be in place as by open ended chucks or containing rings or the like provided on opposite sides of the roller 24 to maintain desired positioning of the roller 24 relative to the platform 22.

The press roll 26 is rotatably mounted adjacent the platform 22 and may be provided as by a spring loaded roller that spans the width of the platform 22. The press roll 26 is located and urged by spring pressure at a spacing and pressure relative to the platform 22 to permit the flooring product 14 with the applied sheet adhesive 12 to pass thereunder while applying pressure sufficient to securably mate the sheet adhesive 12 to the flooring product 14. The spring pressure may be adjusted for flooring products 14 of different densities and thicknesses to ensure proper application of the sheet adhesive 12.

A preferred double-sided dry sheet adhesive 12 is a double-sided polyacrylic adhesive sheet material having a polyethylene terephthalate scrim 12*b* coated on both sides with a polyacrylic-based adhesive. A protective liner sheet 12*c* is provided on one side of the adhesive 12 and the opposite side is an exposed adhesive surface for contacting an underside 14*a* of the flooring products 14. An upper side 14*b* of the flooring products 14 provides a decorative surface. The roll 12*a* preferably has a width of about 48 inches but may be of lesser width depending on the width of the flooring product 14 to which it is being applied.

During use of the apparatus 10, the double-sided dry sheet adhesive 12 is dispensed from the roll 12*a* and travels across the platform 22. An important aspect of operation of the apparatus relates to adjustment structures for desired placement of the roll of sheet adhesive to enable desired tension of the sheet adhesive for contact and marriage with the flooring product or building material to which the sheet adhesive is applied. Marriage of the sheet adhesive is applied through a press roller pressurized by springs which can be adjusted for products of different densities and thicknesses to ensure proper application.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure.

The invention claimed is:

1. Portable apparatus for application of double-sided sheet adhesive to modular flooring products, comprising:

a planar platform having a first end and an opposite second end;

a modular flooring product having an underside slidably disposed along the platform for travel along the platform between the first end and the second end of the platform;

a flooring guide adjustably disposed on the platform for contacting and guiding the modular flooring product along the platform;

a roll of double-sided sheet adhesive mounted adjacent the first end of the platform, wherein the double-sided sheet adhesive is unrolled onto the platform for location beneath the modular flooring product so that an adhesive surface of the sheet adhesive is placed in contact with the underside of the modular flooring product;

a sheet adhesive guide adjustably connected to the flooring guide for contacting the roll to maintain the sheet adhesive in alignment with the flooring guide and the modular flooring product, and to bear against the roll to tension the sheet adhesive as it is applied to the flooring product; and a press roll rotatably mounted adjacent the platform to receive the flooring product having the sheet adhesive applied thereto and operative to apply pressure in a direction toward the platform to securably mate the sheet adhesive to the flooring product.

2. The apparatus of claim 1, further comprising a frame supporting the platform and two sets of wheels connected to the frame, each set of wheels facing different directions.

3. The apparatus of claim 2, wherein one of the wheel sets comprises a lower end wheel set located at a lower end of the frame to locate a wheel on opposite lower sides of the frame, and the other wheel set comprises an upper edge wheel set located at an upper edge of the frame, wherein the wheels of the lower end wheel set and the wheels of the upper edge wheel set are oriented perpendicular to one another.

4. The apparatus of claim 1, wherein an upper surface of the platform has coefficients of static and dynamic friction of about 0.1 or less.

5. Portable apparatus for application of double-sided sheet adhesive to a modular flooring product, comprising a planar platform; a flooring guide on the platform for guiding the modular flooring product along the platform; a roll of double-sided sheet adhesive unrolled onto the platform for marrying with the modular flooring product; and a sheet adhesive guide connected to the flooring guide to maintain the sheet adhesive in alignment with the flooring guide and the modular flooring product, and to tension the sheet adhesive as it is applied to the flooring product.

6. The portable apparatus of claim 5, further comprising a press roll to apply pressure to mate the sheet adhesive to the flooring product.

* * * * *